US010172424B2

(12) United States Patent
Haas et al.

(10) Patent No.: US 10,172,424 B2
(45) Date of Patent: Jan. 8, 2019

(54) HOUSING SHELL FOR A SAFETY BELT BUCKLE, HOUSING FOR A SAFETY BELT BUCKLE, AND METHOD FOR PRODUCING A HOUSING SHELL FOR A SAFETY BELT BUCKLE

(71) Applicant: TRW AUTOMOTIVE GMBH, Alfdorf (DE)

(72) Inventors: Peter Haas, Eschach (DE); Hans-Peter Betz, Böbingen (DE)

(73) Assignee: TRW Automotive GmbH (DE)

( * ) Notice: Subject to any disclaimer, the term of this patent is extended or adjusted under 35 U.S.C. 154(b) by 0 days.

(21) Appl. No.: 15/100,645

(22) PCT Filed: Nov. 24, 2014

(86) PCT No.: PCT/EP2014/003126
§ 371 (c)(1),
(2) Date: Jun. 1, 2016

(87) PCT Pub. No.: WO2015/082052
PCT Pub. Date: Jun. 11, 2015

(65) Prior Publication Data

US 2016/0295972 A1 Oct. 13, 2016

(30) Foreign Application Priority Data

Dec. 2, 2013 (DE) ..... 10 2013 020 619

(51) Int. Cl.
*A44B 11/25* (2006.01)

(52) U.S. Cl.
CPC ..... *A44B 11/2546* (2013.01); *A44B 11/2561* (2013.01)

(58) Field of Classification Search
CPC ..... A44B 11/2546; A44B 11/2503; A44B 11/2507; A44B 11/2511; A44B 11/2515; A44B 11/2519; A44B 11/2523; A44B 11/2526; A44B 11/253; A44B 11/2534; A44B 11/2538; A44B 11/2542; A44B 11/2549; A44B 11/2553; A44B 11/2557; A44B 11/2561; A44B 11/2565; A44B 11/2569; A44B 11/2573; A44B 11/2576; A44B 11/258; A44B 11/2584;
(Continued)

(56) References Cited

U.S. PATENT DOCUMENTS 5,149,189 A * 9/1992 Kawamura ..... A44B 11/2523 24/633
5,307,544 A * 5/1994 Quarberg ..... A44B 11/2576 24/579.11

(Continued)

FOREIGN PATENT DOCUMENTS

WO 2011147529 12/2011
WO 2013117317 6/2013

*Primary Examiner* — Abigail E Troy
(74) *Attorney, Agent, or Firm* — Tarolli, Sundheim, Covell & Tummino LLP

(57) ABSTRACT

A casing shell (10) for a belt buckle is described including at least one sidewall (12, 14, 16) which has an outwardly facing lateral face (22, 24, 26). A groove (23) extending perpendicularly to the longitudinal orientation (L) of the casing shell (10) completely over the lateral face (22, 24, 26) is provided on the lateral face (22, 24, 26). Furthermore a casing for a belt buckle is described.

7 Claims, 3 Drawing Sheets

(58) Field of Classification Search
CPC ..... A44B 11/2588; A44B 11/2592; A44B 11/2596; A44B 11/26; A44B 11/263; A44B 11/266; A44B 11/28; A44B 11/00
See application file for complete search history.

(56) References Cited

U.S. PATENT DOCUMENTS

| | | | | |
|---|---|---|---|---|
| D708,420 | S * | 7/2014 | Rosales | D11/200 |
| 2014/0109349 | A1 | 4/2014 | Blank et al. | |
| 2014/0268844 | A1 | 9/2014 | Knoedl | |
| 2014/0373313 | A1 | 12/2014 | Haas et al. | |

* cited by examiner

HOUSING SHELL FOR A SAFETY BELT BUCKLE, HOUSING FOR A SAFETY BELT BUCKLE, AND METHOD FOR PRODUCING A HOUSING SHELL FOR A SAFETY BELT BUCKLE

RELATED APPLICATIONS

This application corresponds to PCT/EP2014/003126, filed Nov. 24, 2014, which claims the benefit of German Application No. 10 2013 020 619.7, filed Dec. 2, 2013, the subject matter of which are incorporated herein by reference in their entirety.

BACKGROUND OF THE INVENTION

The invention generally relates to belt buckles used for seat belts in automotive vehicles and, accordingly, to a casing shell for a belt buckle as well as a casing for a belt buckle including a casing shell and to a method of manufacturing a casing shell for such belt buckle.

The casing for a belt buckle and the casing shells forming the same typically are injection-molded parts made of plastic material. For manufacturing the injection-molded parts complicated injection molds are used which frequently include, apart from two tool members adjustable relative to each other, also slides so as to enable the manufacture of the required complicated molds of the casings.

In the contact area of the two tool parts the so called mold parting surface is located. Here inevitably the problem arises that irregularities such as unevenness, sharp edges, points or other irregularities are formed on the injection-molded part.

Such irregularities are undesired so that efforts have been made to avoid them. One approach consists in manufacturing the injection mold with especially high precision so as to avoid flashes. However, this results in particularly high manufacturing costs for the injection mold.

SUMMARY OF THE INVENTION

It is the object of the invention to provide a casing shell made of injection-molded plastic and, respectively, a casing of injection-molded plastic for a belt buckle and, respectively, a method of manufacturing a casing shell exhibiting an impression of higher quality with low manufacturing costs.

The object is achieved, according to the invention, by a casing shell for a belt buckle comprising at least one sidewall having an outwardly facing lateral face at which a groove is provided which extends perpendicularly to the longitudinal orientation of the casing shell completely over the lateral face. The principal idea of the invention consists in providing an intended interruption of the outer surface at the casing, wherein said interruption is arranged so that within the same the parting surface between two tool parts (or one tool part and one slide) is arranged and a possible flash is "concealed" therein.

The injection molding tool provided for manufacturing the casing shell thus comprises a slide element having a partial cavity of the entire injection molding tool, the partial cavity extending in the slide element up to a position where the groove is formed at the lateral face.

Another aspect of the invention provides that the sidewall includes a tapering portion in the transition area from the lateral face to an upper side on which at least part of a receiving aperture for a plug-in tongue is formed. The tapering portion of the sidewall is important in terms of manufacture as the casing shell manufactured in the injection molding tool in this way can be ejected more easily from the injection molding tool. Especially the tapering portion is preferably formed on the sidewall between the groove and the upper side.

In accordance with a further aspect of the invention, the sidewall has a curved outer contour. The curvature is formed especially in a way that the manufactured casing shell can equally be easily ejected from the stationary tool part of the injection molding tool.

In particular, the groove is formed in an area of the sidewall having the largest width of the lateral face. Hence the removal of the manufactured casing shell is facilitated as the latter can be easily ejected from the respective tool part, because the widest position of the casing shell is located within the area of the mold parting surface of the injection molding tool.

Another aspect of the invention further provides that the casing shell is made of plastic material. Plastic material is the cheapest and most easily workable material in an injection molding process.

Furthermore, the object is achieved by a casing for a belt buckle, comprising a casing shell of the afore-mentioned type. The casing manufactured in this way may thus be formed of one casing shell or of plural casing shells. Moreover, further shall elements may be provided to interact with the casing shell so as to provide a closed casing.

According to an embodiment, the casing shell includes four sidewalls. The casing thus may be formed of only one single casing shell. Then the casing is formed in one piece, wherein the casing is injected around the internal mechanism of a belt buckle.

Another embodiment of the invention provides that the casing shell interacts with another shell element, wherein a groove is formed in the transition area. The casing shell and the shell element may be manufactured separately from each other, wherein subsequently the internal mechanism of the belt buckle is inserted into the casing shell and then the belt buckle is closed by the shell element. Typically a clip or pin connection is provided for this purpose. The groove in the transition area may be aligned especially with the groove formed on the casing shall so that on the whole a uniform appearance of the casing is resulting.

Especially the casing includes four sides around which the groove continuously extends. Independently of the number of casing shells and shell elements used in the casing, the casing includes a groove continuously extending around all sides. The connecting point of the casing shells and the shell elements as well as the mold parting surface of the manufactured casing shells may altogether be located within the area of the groove.

BRIEF DESCRIPTION OF THE DRAWINGS

Further characteristics and advantages of the invention will be evident from the following description and the drawings which are referred to and in which.

DESCRIPTION

Figure 1:
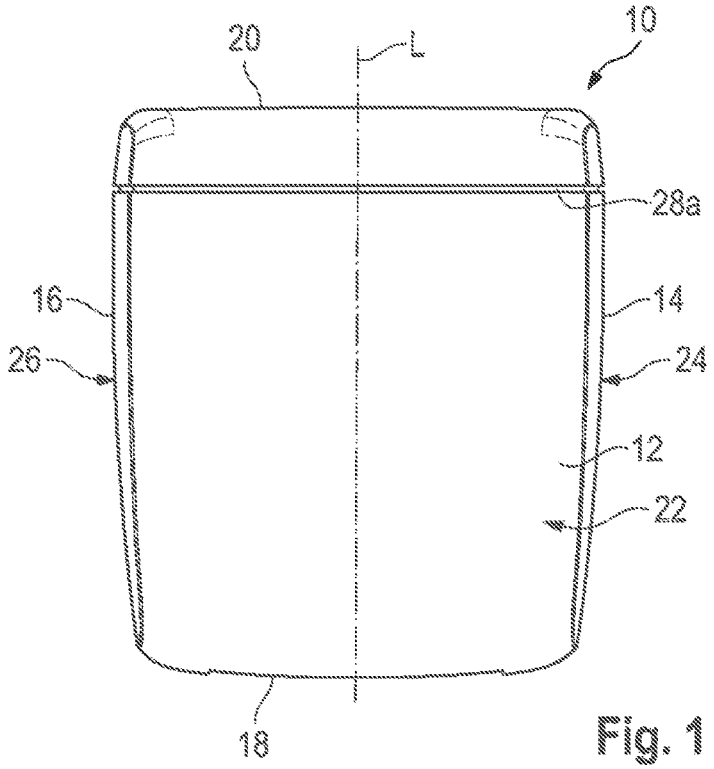
FIG. 1 shows a casing shell according to the invention in a top view.

In FIG. 1 a casing shell 10 for a belt buckle is shown in a top view, wherein a first sidewall 12 is represented which, when the belt buckle is assembled, forms one of the two "large" lateral faces of the casing. The casing shell 10 moreover includes a second sidewall 14 and a third sidewall 18 which form the two narrow lateral faces of the casing when the casing is completely mounted. Further, the casing shell 10 has a lower side 18 on which the belt buckle is usually attached to a mounting fitting as well as an upper side 20 on which usually an insertion aperture for a plug-in tongue disposed on a vehicle seat belt is arranged.

Each of the sidewalls 12, 14, 16 includes a lateral face 22, 24, 26, wherein it is resulting from FIG. 1 that a groove 28*a* is formed on the first lateral face 22. The groove 28*a* continuously extends over the entire first lateral face 22, the groove extending perpendicularly to the longitudinal orientation L of the casing shell 10.

The sidewalls 14, 16 are curved so that a first lateral face 22 having a varying width is resulting, wherein the groove 28*a* is arranged in an area having the largest width.

Figure 2:
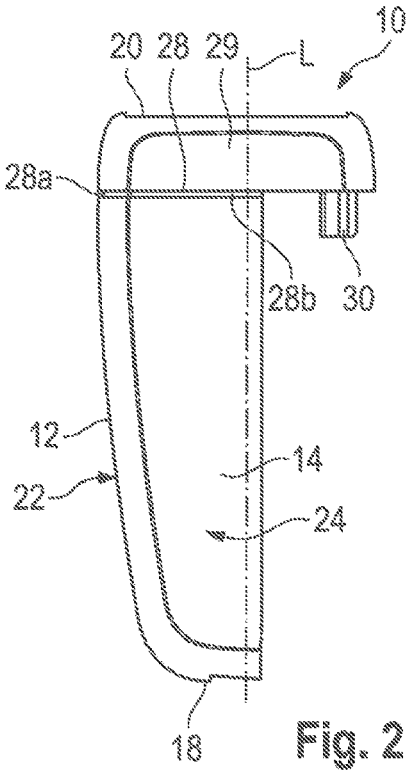
FIG. 2 shows the casing shell from FIG. 1 in a side view.

In FIG. 2 the casing shall 10 of FIG. 1 is shown in a side view, wherein the second sidewall 14 including the second lateral face 24 is illustrated. The casing shell 10 from FIG. 1 is thus shown to be rotated by 90° in FIG. 2.

The second lateral face 24 equally includes a groove 26*b* extending perpendicularly to the longitudinal orientation L of the casing shell 10 and completely over the second lateral face 24. The groove 28*b* is arranged level with the groove 28*a* and in the transition area of the first lateral face 22 to the second lateral face 24 merges with the groove 28*a* so that a continuous groove 28 is formed at the casing shell 10.

The first sidewall 12 is equally curved as can be seen from FIG. 2 so that a second lateral face 24 having a varying width is resulting. The groove 28*b* is arranged analogously to the groove 28*a* at the widest position of the second lateral face 24.

This is applicable mutatis mutandis to the third sidewall 16 and the third lateral face 26 not shown here so that in total a groove 28 is resulting which extends continuously over the first, second and third lateral faces 22, 24, 26 and extends at the widest position of each of the lateral faces 22, 24, 26.

Moreover, one can take from FIG. 2 that the casing shell 10 is not completely closed. Above the groove 28 the casing shell 10 includes a completely circumferential cover element 29 on which the upper side 20 is formed. The cover element 29 is formed so that it has an end opposed to the upper side 20 which at the lateral faces 22, 24, 26 merges into the groove 28 or terminates level with the groove 28.

The casing shell 10 in addition has a fastening pin 30 extending from the end of the cover element 29 and serving for fastening a shell element not shown here so as to provide a closed casing. The connecting point between the casing shell 10 and the shell element then is located level with the groove 28.

Figure 3:
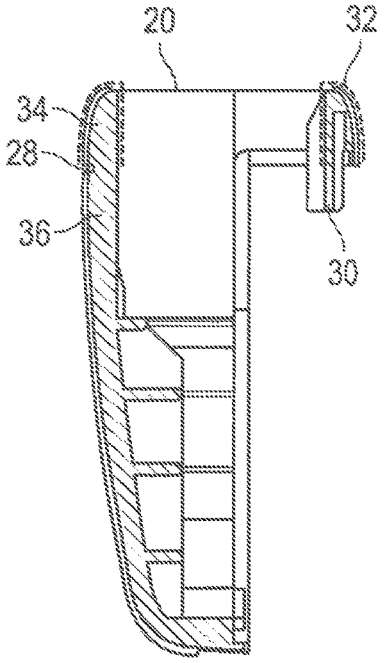
FIG. 3 shows a sectional view of FIG. 2.

In FIG. 3 the casing shell 10 from FIG. 2 is illustrated in a sectional view, wherein moreover a tool part 32 of an injection molding tool employed is schematically indicated by broken lines.

One can take from the sectional view that the first sidewall 12 includes a tapering portion 34 extending from the groove 28 to the upper side 20. The tapering portion 34 has a curved outer contour, whereas the inner contour is straight.

Each of the sidewalls has a tapering portion, said tapering portions being circumferentially interconnected and constituting the laterally closed cover element 29.

The first sidewall 12 further includes another portion 36 which is formed on the opposite side of the groove 28 on the first sidewall 12. The residual portion 36 continuously has a larger material thickness than the tapering portion 34 so that the groove 28 is formed as desired.

Figure 4:
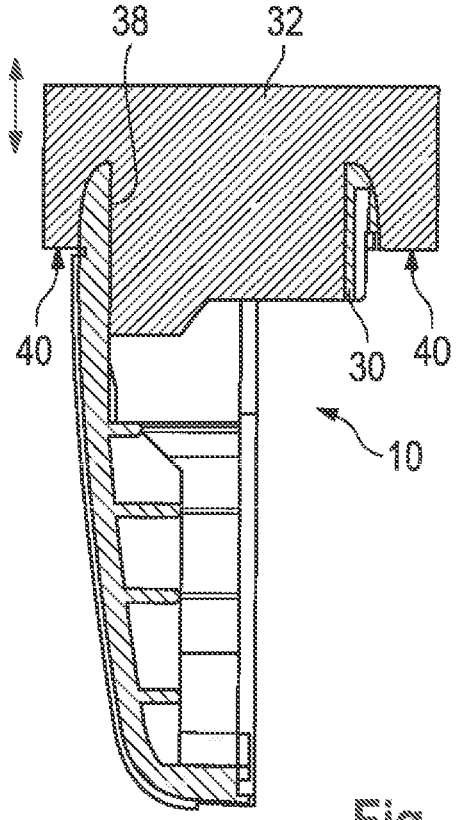
FIG. 4 shows the casing shell of FIGS. 1 to 3 including the slide element arranged thereon in a sectional view.

In FIG. 4 the casing shell 10 from FIGS. 1 to 3 is illustrated including a tool part 32 of the injection molding tool in a sectional view, the tool part 32 being a slide element.

The slide element 32 has a partial cavity 38 being configured so that the tapering portion 34 is manufactured in said partial cavity 38. The partial cavity 33 is further formed to be circumferential in order to fabricate the laterally closed cover element 29 in the partial cavity 38.

In addition, the slide element 32 includes plural contact faces 40 interacting with a further tool part not shown here and forming the mold parting surface of the injection molding tool. The mold parting surface is located within the area of the forming groove 28 at the casing shell 10. Since in the mold parting surface irregularities in the injection molding process have to be expected, these irregularities are utilized to fabricate the intended groove 28.

Figure 5:
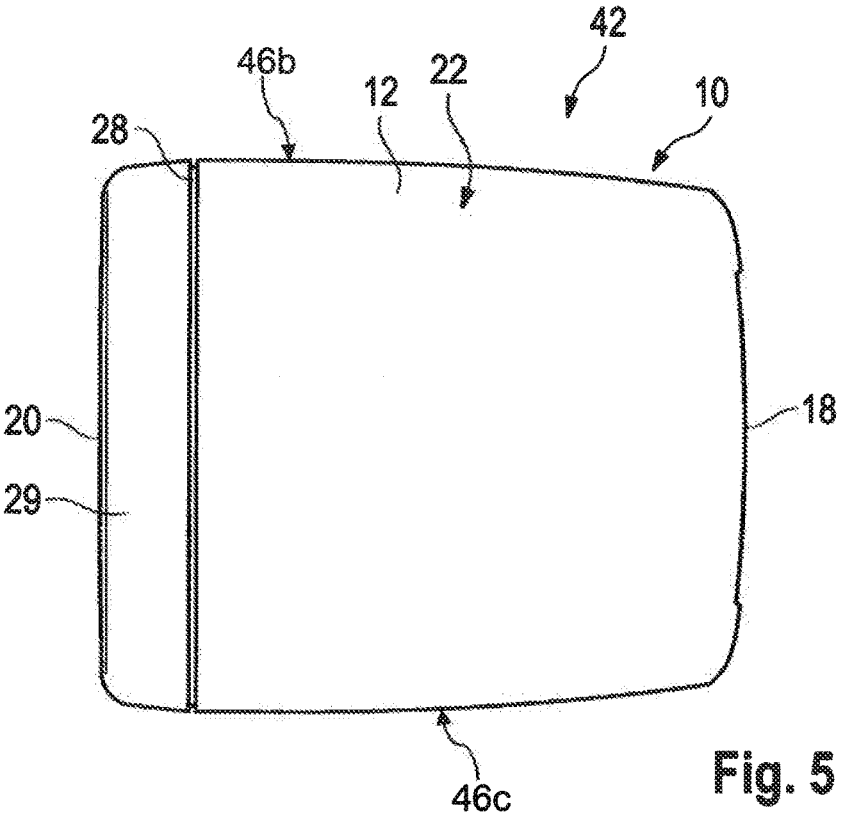
FIG. 5 shows a casing according to the invention in a top view.

In FIG. 5 a casing 42 for a belt buckle is shown which, inter alia, comprises the casing shell 10 from FIGS. 1 to 4, wherein the side view illustrates the first lateral face 22 of the casing shell 10.

Figure 6:
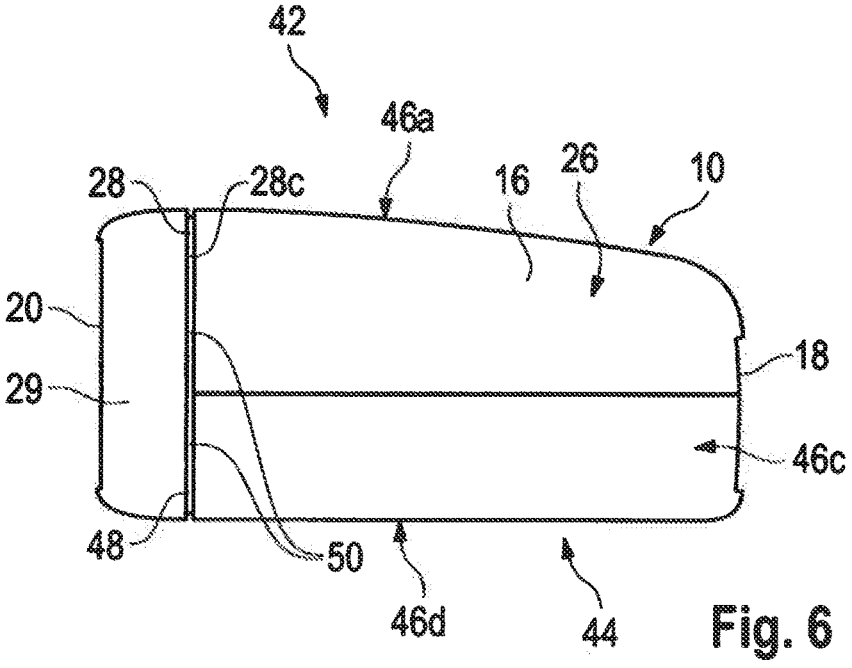
FIG. 6 shows the easing from FIG. 5 in a side view.

FIG. 6 illustrates the casing 42 from a different side so that the third sidewall 16 including the third lateral face 26 of the casing shell 10 as well as the groove 28*c* provided thereon are shown. It is further evident from FIG. 8 that the casing 42 moreover includes a shell element 44 fastened to the casing shell 10 via the fastening pin 30 of the casing shell 10. The shell element 44 in the shown embodiment includes three sidewalls that serve for forming the closed casing 42.

The casing 42 has a total of four sides 46*a*, 46*b*, 46*c*, 46*d*. The first lateral face 22 of the casing shell 10 is associated with the first side 46*a*. Each of the second and third sides 46*b*, 46*c* is partly formed by each of the second and third lateral faces 24, 26 as well as by the shell element 44. The shell element 44 further forms the fourth side 46*d* of the casing 42. Moreover, the cover element 29 extends around all four sides 46*a*, 46*b*, 46*c*, 46*d*.

The shell element 44 is connected to the casing shell 10, especially to the cover element 29, so that in the transition area between the casing shell 10 and the shell element 44 a further groove 48 is formed. The further groove 48 is aligned with the groove 28 of the casing shell 10 so that in total a groove 50 continuously extending around all four sides 46*a*, 46*b*, 46*c*, 46*d* of the casing 42 is formed. In this way it is achieved that the transition area is equally located in the intended groove 50 extending around the entire casing 42 so that the connecting point of the casing shell 10 and of the shell element 44 is not striking and is not perceived as a disturbance.

The groove 50 optically separates the cover element 29 of the casing shell 10 from the residual part of the casing shell 10 and from the shell element 44.

Alternatively, the casing 42 may also be integrally formed of one single casing shell 10 which has four sidewalls.

The invention claimed is:

1. A casing shell made of injection-molded plastic material for a belt buckle, comprising at least one sidewall extending in a longitudinal orientation of the casing shell between an upper side and a lower side, the at least one sidewall having an outwardly facing lateral face on which a groove is provided, the lateral face having a first lateral edge and an opposed second lateral edge, the groove extending partially through the at least one sidewall and perpendicularly to the longitudinal orientation of the casing shell from the first lateral edge to the second lateral edge, the at least one sidewall including a tapering portion within a transition area from the lateral face to the upper side on which at least part of a receiving aperture is formed for a plug-in tongue of the belt buckle.

2. The casing shell according to claim 1, wherein the tapering portion is formed on the at least one sidewall between the groove and the upper side.

3. The casing shell according to claim 1, wherein the at least one sidewall includes a curved outer contour.

4. The casing shell according to claim 1, wherein the groove is formed in an area of the at least one sidewall having a largest width of the lateral face.

5. A casing comprising the casing shell according to claim 1.

6. The casing according to claim 5, wherein the casing shell interacts with a further shell element, the shell element having a groove formed in a transition area.

7. The casing according to claim 5, wherein the casing includes four sides around which the groove continuously extends.

* * * * *